US005868011A

United States Patent [19]

Hawkins et al.

[11] Patent Number: 5,868,011

[45] Date of Patent: Feb. 9, 1999

[54] WATER TRAPS FOR WASHING MACHINES

[75] Inventors: Larry Lee Hawkins; Dwight William Jacobus, both of Louisville; Kevin Harold Kratch, Crestwood; Michael Thomas Beyerle, Pewee Valley, all of Ky.

[73] Assignee: General Electric Company, Louisville, Ky.

[21] Appl. No.: 833,492

[22] Filed: Apr. 4, 1997

[51] Int. Cl.[6] ..... D06F 39/08

[52] U.S. Cl. ..... 68/208; 137/247.41; 415/119

[58] Field of Search ..... 68/208; 134/155, 134/182, 183, 186, 114; 137/247.41, 247.45, 247.47, 247.49, 247.51; 415/119

[56] References Cited

U.S. PATENT DOCUMENTS

| | | | |
|---|---|---|---|
| 2,900,080 | 8/1959 | Raczynski et al. . | |
| 3,124,145 | 3/1964 | Egle . | |
| 3,124,146 | 3/1964 | Jenkins et al. . | |
| 3,174,489 | 3/1965 | Jellies et al. | 134/186 X |
| 3,249,118 | 5/1966 | Bochan . | |
| 3,314,255 | 4/1967 | Neumann et al. . | |
| 3,367,153 | 2/1968 | Brubaker et al. . | |
| 3,954,116 | 5/1976 | Guth et al. | 134/183 |
| 4,485,645 | 12/1984 | Mulder et al. . | |
| 4,821,537 | 4/1989 | Zinkann et al. . | |
| 4,833,900 | 5/1989 | Babuin et al. . | |
| 5,143,513 | 9/1992 | Ellingson et al. | 415/119 |

FOREIGN PATENT DOCUMENTS

| | | | |
|---|---|---|---|
| 550681 | 9/1956 | Belgium | 137/247.51 |
| 931467 | 7/1963 | United Kingdom | 137/247.49 |
| 2253133 | 9/1992 | United Kingdom | 68/208 |

*Primary Examiner*—Philip R. Coe
*Attorney, Agent, or Firm*—H. Neil Houser

[57] ABSTRACT

Apparatus including water traps for containing pump gurgling noise within a washing machine are described. In one embodiment, tub outlet openings are formed in the washing machine tub bottom wall, and the apparatus includes an inlet in flow communication, and integral, with the tub water outlet. The pump inlet hose is coupled to the apparatus outlet so that the outlet is in flow communication with the water pump. The water trap is located between the apparatus inlet and outlet, and the water trap includes a u-shaped channel, a baffle extending from a lower surface of the tub bottom wall, and a standpipe. The u-shaped channel includes a water reservoir portion at an elevation below an end of the standpipe. In operation, water from the tub is discharged from the tub through the tub water outlets and into the apparatus. The water accumulates in the water reservoir portion, and if the amount of water discharged into the apparatus exceeds the volume of the water reservoir portion, the water spills over into the standpipe and is discharged from the apparatus through the outlet and into the pump inlet hose. Water discharged into the pump inlet hose is discharged from the washing machine by the water pump. The pump gurgling noise which may be generated as the pump oscillates between pumping water and air is substantially blocked by the water retained in the water trap.

15 Claims, 3 Drawing Sheets

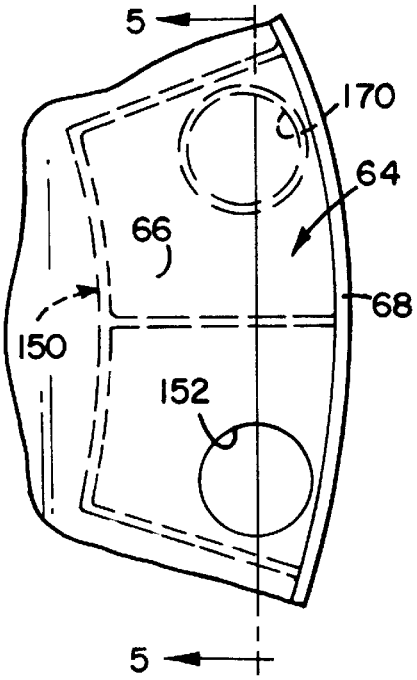
Fig. 4
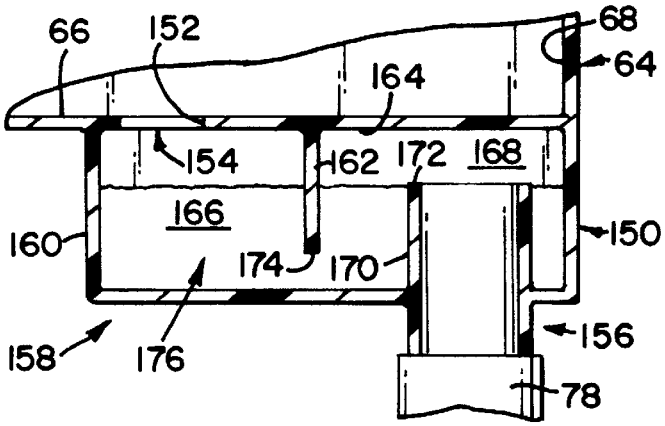
Fig. 5
Fig. 7
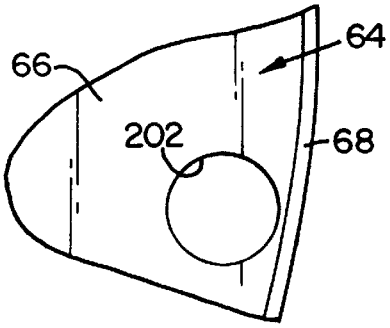
Fig. 6
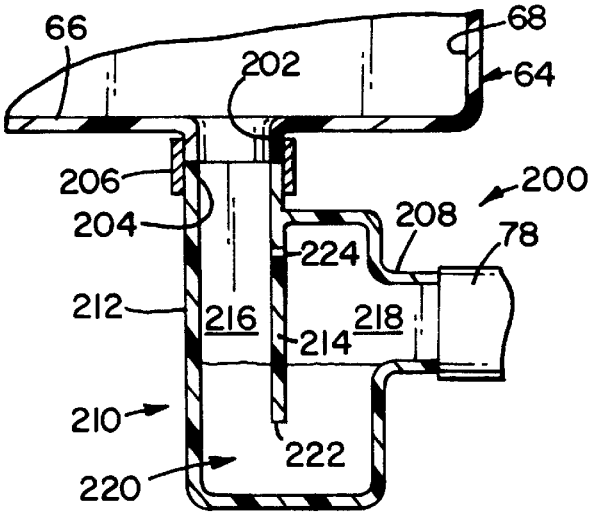
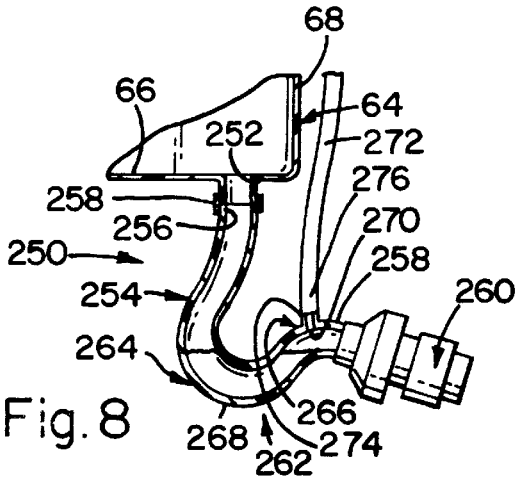
Fig. 8
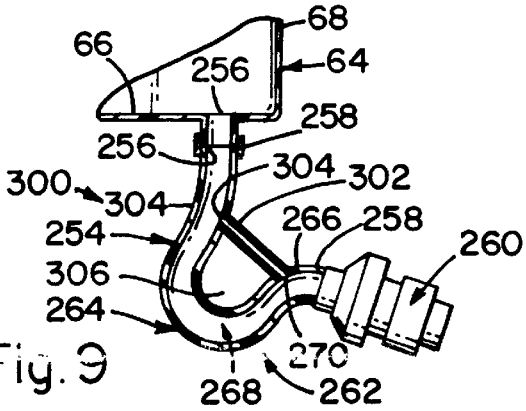
Fig. 9

WATER TRAPS FOR WASHING MACHINES

FIELD OF THE INVENTION

This invention relates generally to washing machines and, more particularly, to water traps for use in washing machines for blocking surging, or gurgling, noises of the washing machine pumps.

BACKGROUND OF THE INVENTION

Clothes washing machines typically include a drain pump for pumping water from the washing container, or tub, prior to beginning a spin cycle. The pump typically is located below the tub so that water drains, due to gravity forces, from the tub and into the pump. Draining the free water, i.e., water not absorbed in clothes located in the tub, from the tub prior to the spin cycle improves washing machine performance during the spin cycle by decreasing the occurrences and severity of out of balance loads.

Although draining the water from the tub before the spin cycle provides performance advantages, if the pump continues pumping operations after the tub is substantially empty of free water and before the spin cycle, a pump gurgling noise will be generated as the pump oscillates between pumping water and air. Once the basket begins to spin, water extracted from the clothes flows from the tub to the pump inlet and the pump gurgling noise temporarily stops. However, as the spin cycle proceeds, the amount of water extracted from the clothes will decrease and the pump will resume surging due to a lack of water at the pump inlet.

The pump gurgling noise may be annoying, particularly to occupants of a residence if the washing machine is located in a living area of the residence. It would be desirable to contain such gurgling noise within the washing machine, without adversely affecting the performance of the machine.

Known attempts to contain the gurgling noise include positioning a flapper valve over the tub water outlet. The flapper valve is biased so that water can flow from the tub to the pump but blocks flow from the pump toward the tub. In operation, once all the free water has been drained from the tub, the flapper valve closes and blocks the pump gurgling noise from the tub. Similarly, during the spin cycle, once the water has been extracted from the clothes in the tub, the flapper valve closes and again blocks the gurgling noise. By blocking the pump gurgling noise from the tub, the gurgling noise is substantially contained in the washing machine.

Although the flapper valve does facilitate containing the gurgling noise, the flapper valve is expensive to design and manufacture. Moreover, it is believed that with a flapper valve, lint can accumulate at the valve, thereby decreasing the pump out rate of water from the tub and trapping suds in the basket.

Another known device includes electrical sensors located in the tub so that once the water level within the tub falls below some predetermined level, the pump motor is deenergized. If the pump motor is deenergized before the water level falls to a level at which the pump begins to generate the gurgling noise, the gurgling noise can be eliminated. Such electrical sensors and controls, however, also add cost and complexity to the washing machine.

As explained above, it would be desirable to contain the pump gurgling within the washing machine. In addition, it would be desirable to provide such noise containment without substantially increasing the cost and complexity of the washing machine.

SUMMARY OF THE INVENTION

These and other objects may be attained in an apparatus including a water trap for containing pump gurgling noise within the washing machine. In one embodiment, for example, tub outlet openings are formed in the washing machine tub bottom wall, and the apparatus includes an inlet in flow communication, and integral, with the tub water outlet. The pump inlet hose is coupled to the apparatus outlet so that the outlet is in flow communication with the water pump. The water trap is located between the apparatus inlet and outlet, and in the one embodiment, the water trap includes a u-shaped channel, a baffle extending from a lower surface of the tub bottom wall, and a standpipe. The u-shaped channel includes a water reservoir portion at an elevation below an end of the standpipe.

In operation, water from the tub is discharged from the tub through the tub water outlets and into the apparatus. Water accumulates in the water reservoir portion, and if the amount of water discharged into the apparatus exceeds the volume of the water reservoir portion, the water spills over into the standpipe and is discharged from the apparatus through the outlet and into the pump inlet hose. Water discharged into the pump inlet hose is discharged from the washing machine by the water pump.

The pump gurgling noise which may be generated as the pump oscillates between pumping water and air is substantially blocked by the water retained in the water trap. Specifically, if the pump begins to surge, the noise is transmitted through the pump inlet hose to the apparatus. The water in the water reservoir portion, and the bottom wall of tub, however, block the noise from entering into the tub. Therefore, the pump gurgling noise is substantially contained within the washing machine.

The water trap described above substantially contains the pump surging within the washing machine. In addition, the water trap provides such noise containment without substantially increasing the cost and complexity of the washing machine.

BRIEF DESCRIPTION OF THE DRAWINGS

FIG. 4 is a plan view of a wash tub and a water trap in accordance with another embodiment of the present invention.

FIG. 5 is a cross section view through line 5—5 in FIG. 4.

FIG. 6 is a plan view of a wash tub and a water trap in accordance with yet another embodiment of the present invention.

FIG. 7 is a cross section view of the wash tub and water trap shown in FIG. 6.

FIG. 8 is a cross section view of a wash tub and still yet another embodiment of a water trap in accordance with the present invention.

FIG. 9 is a cross section view of a wash tub and another embodiment of a water trap in accordance with the present invention.

DETAILED DESCRIPTION OF THE DRAWINGS

Figure 1:
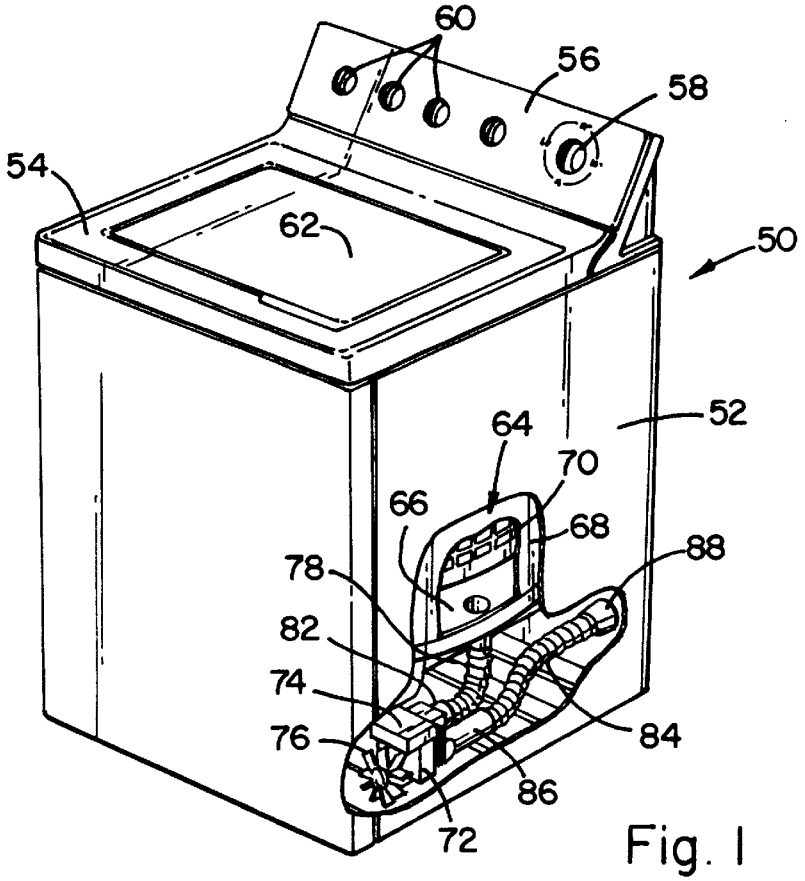
FIG. 1 is a perspective view of a washing machine with parts cut-away.

FIG. 1 is a perspective view of a washing machine 50 with parts cut-away. Washing machine 50 includes a cabinet 52 and a cover 54. A backsplash 56 extends from cover 54, and a timer 58 and various washing machine controls 60 are secured to backsplash 56. A lid 62 is rotatably mounted to cover 54.

Washing machine 50 also includes a tub 64 having a bottom wall 66 and a sidewall 68, and a basket 70 positioned therein. As is well known, basket 70 rotates relative to tub 64. Washing machine 50 also includes a water pump 72 including a pump motor 74 and a motor fan 76. A pump inlet hose 78 extends from a tub water outlet 80 in bottom wall 66 to a pump inlet 82, and a pump outlet hose 84 extends from a pump outlet 86 to a washing machine water outlet 88.

Prior to operation, clothes are located in basket 70 and then washing machine operations are initiated by an operator using controls 60 and timer 58. Prior to the spin cycle, tub 64 is filled with water. Some of the water is absorbed in the clothes and some of the water is free water, i.e., not absorbed in the clothes. Draining the free water from tub 64 prior to the spin cycle improves washing machine performance during the spin cycle by decreasing the occurrences and severity of out of balance loads. Since pump 72 is located below tub 64, the free water drains, due to gravity forces, from tub 64 and into drain pump 72.

Even after the free water has been drained from tub 64, however, pump 72 continues pumping operations. A pump gurgling noise will be generated as pump 72 oscillates between pumping water and air. The pump gurgling noise is transmitted through pump inlet hose 78 to tub 64. The noise then escapes from machine 50 through the interface between lid 62 and cover 54. Once basket 70 begins to spin, water extracted from the clothes flows from tub 64 to pump inlet 82 through pump inlet hose 78, and the pump gurgling noise temporarily stops. However, as the spin cycle proceeds, the amount of water extracted from the clothes will decrease and pump 72 will resume surging due to a lack of water at pump inlet 82.

The pump gurgling noise may be annoying, and it would be desirable to contain such gurgling noise within washing machine 50. However, the efficiency of machine 50 preferably would not be adversely affected by containing the gurgling noise within machine 50.

Figure 2:
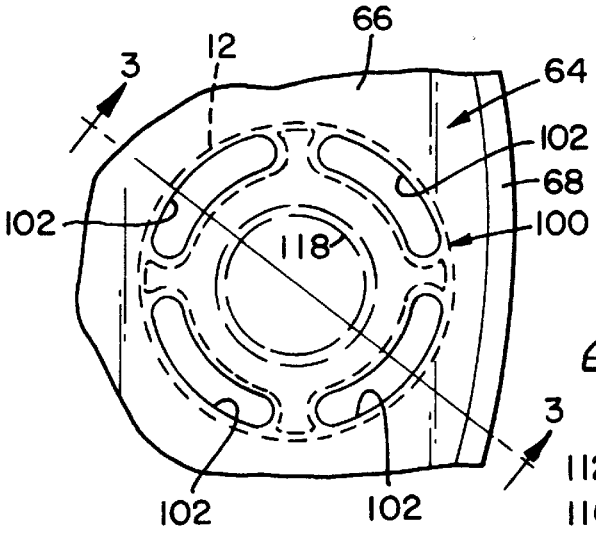
FIG. 2 is a plan view of a wash tub and a water trap in accordance with one embodiment of the present invention.
Figure 3:
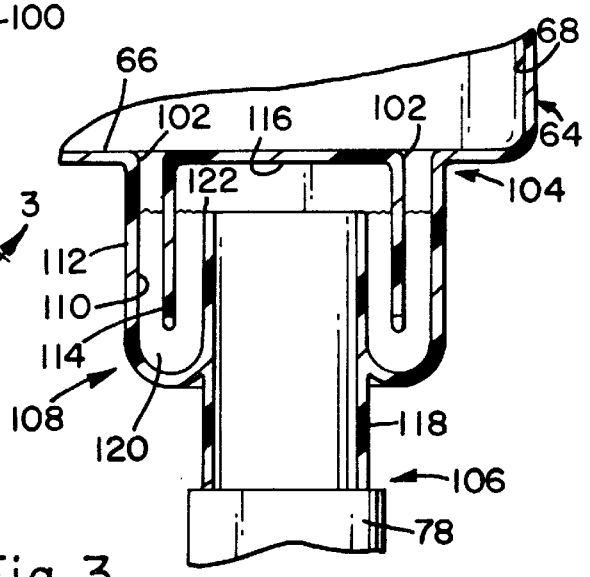
FIG. 3 is a cross section view through line 3—3 in FIG. 2.

Referring to FIGS. 2 and 3, and in accordance with one embodiment of the present invention, an apparatus 100 is provided for blocking the pump gurgling noise. Tub outlet openings 102 are formed in tub bottom wall 66 and apparatus 100 includes an inlet 104 in flow communication, and integral, with tub water outlet openings 102, and an outlet 106. Pump inlet hose 78 is coupled to outlet 106 so that outlet 106 is in flow communication with the water pump (not shown). For example, inlet hose 78 can be pushed over a portion of outlet 106.

Apparatus 100 further includes a water trap 108 located between inlet 104 and outlet 106. Water trap 108 includes a u-shaped channel 110 formed by a wall 112 of apparatus 100, a baffle 114 extending from a lower surface 116 of tub bottom wall 66, and a standpipe 118. U-shaped channel 110 includes a water reservoir portion 120 at an elevation below an end 122 of standpipe 118.

Apparatus 100 can be molded, using a moldable plastic, integral with tub 64. Alternatively, apparatus 100 can be molded separate from tub 64 and then secured thereto using, for example, a plastic heat joining process.

In operation, water from tub 64 is discharged from tub 64 through tub water outlets 102 and into apparatus 100. The water accumulates in water reservoir portion 120, and if the amount of water discharged into apparatus 100 exceeds the volume of water reservoir portion 120, the water spills over into standpipe 118 and is discharged from apparatus 100 through outlet 106 and into pump inlet hose 78. Water discharged into pump inlet hose 78 is discharged from washing machine 50 by water pump 72. (FIG. 1).

The pump gurgling noise which may be generated as pump 72 oscillates between pumping water and air is blocked by the water retained in water trap 108. Specifically, if pump 72 begins to surge, the noise is transmitted through pump inlet hose 78 to apparatus 100. The water in water reservoir 120, and bottom wall 66 of tub 64, however, substantially block the noise. Therefore, the pump gurgling noise is substantially contained within washing machine 50.

Of course, many other water trap configurations are contemplated and possible for blocking the pump gurgling noise. Set forth below are descriptions of some alternative water trap configurations. In addition, the water trap apparatus described herein can be used in connection with many different washing machines including, for example, washing machine model number WWSR3090T, commercially available from General Electric Company, Appliance Park, Louisville, Ky. 40225.

FIGS. 4 and 5 illustrate an apparatus 150 for blocking the pump gurgling noise in accordance with another embodiment of the present invention. A tub outlet opening 152 is formed in tub bottom wall 66 and apparatus 150 includes an inlet 154 in flow communication, and integral, with tub water outlet 152, and an outlet 156. Pump inlet hose 78 is coupled to outlet 156 so that outlet 156 is in flow communication with water pump 72 (not shown). For example, inlet hose 78 can be pushed over a portion of outlet 156.

Apparatus 150 further includes a water trap 158 located between inlet 154 and outlet 156. Water trap 158 includes a housing 160 and a baffle 162 extending from a lower surface 164 of tub bottom wall 66. Housing 160 includes a first chamber 166 and a second chamber 168 partially separated by baffle 162 and in flow communication. First chamber 166 is in flow communication with tub 64, and a standpipe 170 extends into second chamber 168. Specifically, standpipe 170 extends into second chamber 168 so that an end 172 of standpipe 170 is located at an elevation above an elevation of an end 174 of baffle 162. A water reservoir portion 176 is formed in water trap 158 by housing 160, baffle 162 and standpipe 170.

Apparatus 150 can be molded, using a moldable plastic, integral with tub 64. Alternatively, apparatus 150 can be molded separate from tub 64 and then secured thereto using, for example, a plastic heat joining process.

In operation, water from tub 64 is discharged from tub 64 through tub water outlet 152 and into apparatus 150. The water accumulates in water reservoir portion 176, and if the water discharged into apparatus 150 exceeds the volume of water reservoir portion 176, the water spills over into standpipe 170 and is discharged from apparatus 150 through outlet 156 and into pump inlet hose 78. Water discharged into pump inlet hose 78 is discharged from washing machine 50 by water pump 72 (FIG. 1).

The pump gurgling noise which may be generated as pump 72 oscillates between pumping water and air is blocked by the water retained in water trap 158. Specifically, if pump 72 begins to surge, the noise is transmitted through pump inlet hose 78 to apparatus 150. The water in water reservoir 176, and bottom wall 164 of tub 64, however, substantially block the noise. Therefore, the pump gurgling noise is substantially contained within washing machine 50.

FIGS. 6 and 7 illustrate an apparatus 200 in accordance with yet another embodiment of the present invention. A tub outlet 202 extends from tub bottom wall 66 and apparatus 200 includes an inlet 204 coupled to tub outlet 202 by a clamp 206. Inlet 204 is in flow communication with tub water outlet 202. Apparatus 200 also includes an outlet 208, and pump inlet hose 78 is coupled to outlet 208 so that outlet 208 is in flow communication with water pump 72 (FIG. 1). For example, inlet hose 78 can be pushed over a portion of outlet 208.

Apparatus 200 further includes a water trap 210 located between inlet 204 and outlet 208. Water trap 210 includes a housing 212 and a baffle 214 partially separating housing 212 into a first chamber 216 and a second chamber 218. First and second chambers 216 and 218 are in flow communication. First chamber 216 also is in flow communication with tub 64, and second chamber 218 is in flow communication with pump inlet hose 78. A water reservoir portion 220 is formed by housing 212, and outlet 208 is located at an elevation above an elevation of an end 222 of baffle 214. An air bleed opening 224 is located in baffle 214 at an elevation above reservoir portion 220 so that air displaced by water in second chamber 218 can be communicated to first chamber 216 and out through tub 64 even if reservoir portion 220 is filled with water. Apparatus 200 can be molded using a moldable plastic, and apparatus 200 can be molded separate from tub 64 or integral with tub 64.

In operation, water from tub 64 is discharged from tub 64 through tub water outlet 202 and into apparatus 200. The water accumulates in water reservoir portion 220, and if the water discharged into apparatus 200 exceeds the volume of water reservoir portion 220, the water is discharged through outlet 208 and into pump inlet hose 78. Water discharged into pump inlet hose 78 is discharged from washing machine 50 by water pump 72 (FIG. 1).

The pump gurgling noise which may be generated as pump 72 oscillates between pumping water and air is blocked by the water retained in water trap 210. Specifically, if pump 72 begins to surge, the noise is transmitted through pump inlet hose 78 to apparatus 200. The water in water reservoir portion 220, and bottom wall 66 of tub 64, however, substantially block the noise from entering into tub 64. Therefore, the pump gurgling noise is substantially contained within washing machine 50.

FIG. 8 is a cross section view of still yet another embodiment of an apparatus 250 in accordance with the present invention. A tub outlet 252 extends from tub bottom wall 66 and apparatus 250 includes J-shaped tube 254 having an inlet 256 coupled to tub outlet 252 by a clamp 258. Inlet 256 is in flow communication with tub water outlet 252. Apparatus 250 also includes an outlet 258, and a pump inlet coupling 260 is connected to outlet 258 so that outlet 258 is in flow communication with water pump 72.

Apparatus 250 further includes a water trap 262 located between inlet 256 and outlet 258. Specifically, water trap 262 is formed by bends 264 and 266 in J-shaped tube 254. Trap 262 includes a water reservoir portion 268, and outlet 258 is located at an elevation above an elevation of reservoir portion 268.

An air bleed opening 270 is located in tube 254 at outlet 258. An air bleed tube 272 is coupled, using a coupling 274, at one end 276 to air bleed opening 270. Air bleed tube 272 has a free end (not shown), and air bleed tube 272 has a length sufficient so that the free end of tube 272 can be located at an elevation above inlet 256. Air can be discharged from J-shaped tube 254 through air bleed tube 272.

In operation, water from tub 64 is discharged from tub 64 through tub water outlet 252 and into tube 254. The water accumulates in water reservoir portion 268, and if the water discharged into tube 254 exceeds the volume of water reservoir portion 268, the water flows from J-shaped tube 254 into pump coupling 260, which, of course, would be connected to water pump 72 (FIG. 1).

The pump gurgling noise which may be generated as pump 72 oscillates between pumping water and air is blocked by the water retained in water trap 262. Specifically, if pump 72 begins to surge, the noise is transmitted through pump coupling 260 and into J-shaped tube 254. The water in water reservoir portion 268, however, substantially blocks the noise from entering into tub 64. Therefore, the pump gurgling noise is substantially contained within washing machine 50.

FIG. 9 is a cross section view of another embodiment of an apparatus 300 in accordance with the present invention. Apparatus 300 differs from apparatus 250 (FIG. 8) only in that J-shaped tube 254 and air bleed tube 302 are integral, and J-shaped tube 254 includes an opening 304 at an elevation above the highest elevation of reservoir portion 268. Air bleed tube 302 extends from and between openings 270 and 304, and a membrane 306 is formed and extends between air bleed tube 302 and J-shaped tube 254. Membrane 306 provides rigid support for air bleed tube 302. Components of apparatus 300 which are identical, except as noted above, to components of apparatus 250 are indicated in FIG. 9 using the same reference numerals as used in FIG. 8. Apparatus 300 also functions in a manner identical to apparatus 250 with the exception that air displaced through air bleed tube 302 is discharged into tub 64 through tube inlet 256.

Figure 10:
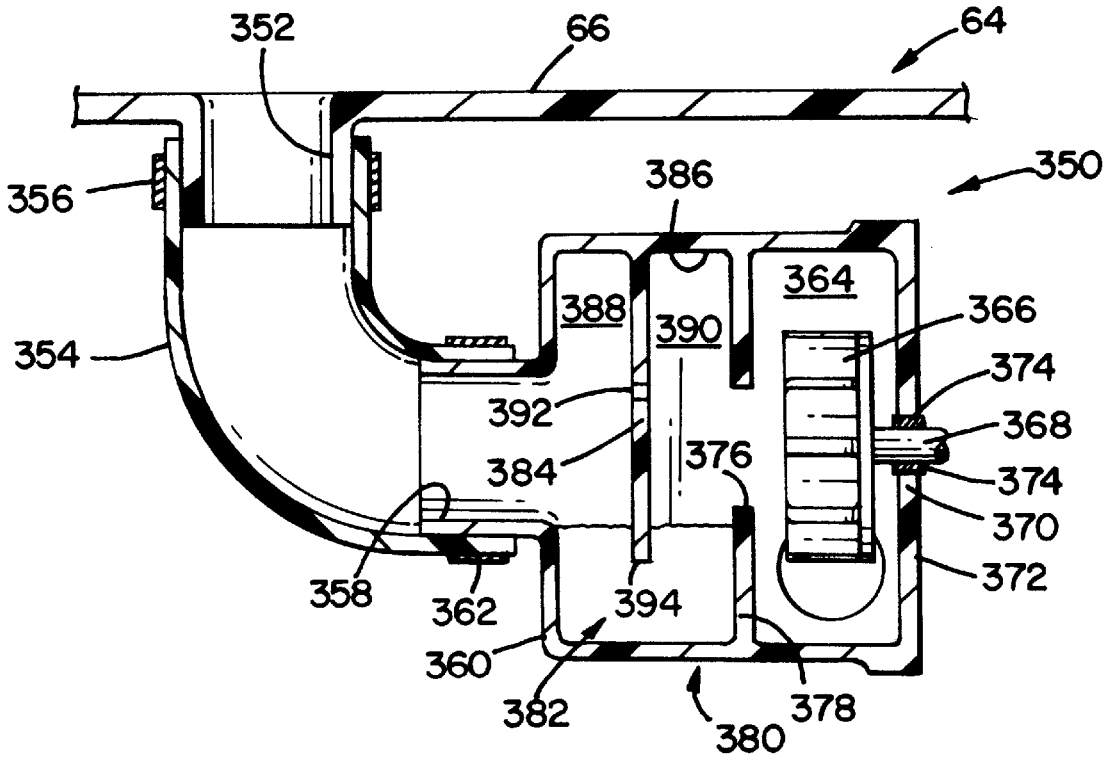
FIG. 10 is a cross section view of a wash tub and yet another embodiment of a water trap in accordance with the present invention.

FIG. 10 is a cross section view of an apparatus 350 for blocking the pump gurgling noise in accordance with another embodiment of the present invention. A tub outlet 352 is formed in tub bottom wall 66, and apparatus 350 includes a flexible tube 354 connected to tub outlet 352 by a clamp 356 and extending from tub 352 outlet to an inlet 358 of a housing 360. Tube 354 is secured to housing inlet 358 by a clamp 362.

Housing 360 serves as an integral water trap and pump housing, and includes an impeller chamber 364 having a pump impeller 366 therein. Pump impeller 366 is secured to an impeller shaft 368 which extends through an opening 370 in a housing wall 372 and is mounted on bearings 374. Impeller chamber 364 includes an inlet opening 376 in a housing wall 378 and is in flow communication with a water trap 380.

Water trap 380 includes a reservoir portion 382, and a baffle 384 extending from an inner surface 386 of housing 360. Housing 360 also includes a first chamber 388 and a second chamber 390 partially separated by baffle 384 and in flow communication. First chamber 388 is in flow communication with tube 354, and second chamber 390 is in flow communication with inlet opening 376 to impeller chamber 364. An air bleed opening 392 is located in baffle 384 at a location above water reservoir portion 382. An end 394 of baffle 384 is at an elevation below an elevation of impeller inlet opening 376. Housing 360 can be molded, using a moldable plastic.

In operation, water from tub 64 is discharged from tub 64 through tub water outlet 352 and into tube 354. Water flows through tube 354 and into water reservoir portion 382. The water accumulates in water reservoir portion 382, and if the water discharged from tub 64 exceeds the volume of water reservoir portion 382, the water spills over into impeller chamber 364. Impeller 366 rotates with shaft 368 and discharges water from housing 360 through an outlet (not shown) in housing 360.

The pump gurgling noise which may be generated as pump 72 oscillates between pumping water and air is blocked by the water retained in water trap 380 and housing 360. Specifically, if pump 72 begins to surge, the noise is transmitted from impeller chamber 364 to water trap 380. The water in water reservoir portion 382 and housing 360 substantially block the noise. Therefore, the pump gurgling noise is substantially contained within washing machine 50.

The apparatus described above include water traps which contain the pump surging within the washing machine. In addition, the apparatus provide such noise containment without substantially increasing the cost and complexity of the washing machine.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. Apparatus for a clothes washing machine including a tub and a water pump, said apparatus comprising:

an inlet configured to be in flow communication with the tub;

an outlet configured to be in flow communication with the water pump; and a water trap located between said inlet and said outlet, said water trap configured to substantially block communication of noise from the pump to the tub, said water trap comprising a water reservoir portion, a baffle extending from a bottom wall of the tub, and a standpipe extending into said water reservoir portion.

2. Apparatus in accordance with claim 1 wherein said inlet is integral with the tub.

3. Apparatus in accordance with claim 1 wherein said water trap comprises a u-shaped channel, said standpipe in flow communication with said u-shaped channel.

4. Apparatus in accordance with claim 1 wherein said water trap comprises a housing comprising a first chamber and a second chamber partially separated by said baffle and in flow communication, said first chamber in flow communication with the tub, said standpipe extending into said second chamber.

5. Apparatus in accordance with claim 4 wherein a water outlet is located in the tub, and said first chamber is in flow communication with the tub water outlet.

6. Apparatus in accordance with claim 4 wherein an end of said standpipe is located at an elevation above an elevation of an end of said baffle.

7. Apparatus in accordance with claim 1 wherein said water trap comprises a housing, said baffle extending into said housing, said outlet located at an elevation above an elevation of an end of said baffle.

8. A washing machine comprising:

a tub including a water outlet;

a water pump; and a water trap apparatus comprising an inlet configured to be in flow communication with said tub, an outlet configured to be in flow communication with said water pump, and a water trap located between said inlet and said outlet, said water trap configured to substantially block communication of noise from said pump to said tub, said water trap comprising a water reservoir portion, a baffle extending from a bottom wall of said tub, and a standpipe extending into said water reservoir portion.

9. A washing machine in accordance with claim 8 wherein said water trap comprises a u-shaped channel, said standpipe in flow communication with said u-shaped channel.

10. A washing machine in accordance with claim 8 wherein said water trap comprises a housing, said baffle extending into said housing, said outlet located at an elevation above an elevation of an end of said baffle.

11. Apparatus comprising:

a tub comprising a bottom wall having at least one opening therein;

a water pump; and a water trap apparatus comprising an inlet in flow communication with said tub through said opening, an outlet in flow communication with said water pump, and a water trap between and in flow communication with said inlet and said outlet, said water trap comprising a water reservoir portion and a baffle extending from said bottom wall of said tub into said water reservoir portion.

12. Apparatus in accordance with claim 11 wherein said water trap comprises a u-shaped channel and a standpipe in flow communication with said u-shaped channel.

13. Apparatus machine in accordance with claim 11 wherein said water trap comprises a housing, said baffle extending into said housing, said outlet located at an elevation above an elevation of an end of said baffle.

14. Apparatus in accordance with claim 11 wherein said water trap comprises a housing comprising a first chamber and a second chamber partially separated by said baffle and in flow communication, said first chamber in flow communication with said tub, said standpipe extending into said second chamber.

15. Apparatus in accordance with claim 14 wherein said standpipe extends into said second chamber so that an end of said standpipe is located at an elevation above an elevation of an end of said baffle.

* * * * *